US006607410B1

(12) United States Patent
Neisen et al.

(10) Patent No.: US 6,607,410 B1
(45) Date of Patent: Aug. 19, 2003

(54) SINGLE CYLINDER TILT-TRIM ASSEMBLY FOR BOATS USING A STERN DRIVE SYSTEM

(75) Inventors: Gerlad F. Neisen, Rockport, TX (US); Mark Whiteside, Zion, WI (US)

(73) Assignee: Bombardier Motor Coperation of America, Grant, FL (US)

( * ) Notice: Subject to any disclaimer, the term of this patent is extended or adjusted under 35 U.S.C. 154(b) by 0 days.

(21) Appl. No.: 09/591,884

(22) Filed: Jun. 9, 2000

Related U.S. Application Data

(63) Continuation-in-part of application No. 09/468,569, filed on Dec. 21, 1999.

(51) Int. Cl.[7] ..... B63H 20/08
(52) U.S. Cl. ..... 440/57; 440/61
(58) Field of Search ..... 440/57, 61

(56) References Cited

U.S. PATENT DOCUMENTS 3,888,203 A * 6/1975 Lohse ..... 440/57
4,037,558 A * 7/1977 Nossiter ..... 440/57
4,557,696 A 12/1985 Nakahama
4,659,315 A 4/1987 Bland et al.
4,775,342 A * 10/1988 Connor et al. ..... 440/57
5,149,286 A 9/1992 Tsujii
5,290,182 A * 3/1994 Mondelop ..... 440/57
5,562,508 A 10/1996 Rodskier et al.
5,647,780 A 7/1997 Hosoi
5,766,048 A 6/1998 Iwashita
5,975,968 A 11/1999 Nakamura
5,984,741 A 11/1999 Nakamura et al.
5,989,085 A 11/1999 Suzuki
6,007,391 A 12/1999 Eilert
6,015,318 A 1/2000 Uematsu et al.
6,039,617 A 3/2000 Nakamura
6,042,434 A 3/2000 Nakamura
6,048,234 A 4/2000 Uematsu et al.

* cited by examiner

*Primary Examiner*—S. Joseph Morano
*Assistant Examiner*—Andy Wright
(74) *Attorney, Agent, or Firm*—Ziolkowski Patent Solutions Group, LLC

(57) ABSTRACT

A stern drive system having an outdrive rotatable about a generally horizontal axis to impart a desired trim or tilt to the drive system is provided. The system includes a gimbal ring that defines an inner region. The gimbal ring is configured to pivotally receive a first anchor pin. A tilt-trim assembly is affixed to the outdrive, and the tilt-trim assembly has one respective end thereof configured to pivotally receive a second anchor pin supported by the outdrive. The assembly includes a single cylinder through the inner region of the gimbal ring and has one end thereof connected to the first anchor pin so that when the cylinder is actuated the outdrive is rotated about the generally horizontal axis.

22 Claims, 3 Drawing Sheets

SINGLE CYLINDER TILT-TRIM ASSEMBLY FOR BOATS USING A STERN DRIVE SYSTEM

SPECIFIC DATA RELATED TO THE INVENTION

This application is a Continuation-In-Part of U.S. application Ser. No. 9/468,569 filed Dec. 21, 1999.

BACKGROUND OF THE INVENTION

The present invention is generally related to a tilt-trim assembly for marine propulsion devices, and, more particularly, to a tilt-trim assembly for a stern drive propulsion system.

In marine propulsion devices, it is common to have hydraulic cylinder/piston assemblies located externally of the boat for effecting pivotal movement of the propulsion unit relative to its mounting bracket. For example, in marine propulsion devices of the stern drive or inboard/outboard type, it is common to have hydraulic cylinder/piston assemblies connected between the gimbal ring and the propulsion unit for effecting tilting movement of the propulsion unit relative to the gimbal ring. On a typical stern drive application, two cylinders that respectively straddle each side of the propulsion unit are employed for effecting that tilting movement. Although use of two cylinders provides effective tilt/trimming operations, it will be appreciated that such laterally-straddling cylinders may create hydrodynamic drag affecting boat acceleration and fuel efficiency.

Thus, it will be desirable to provide a tilt/trimming assembly made up of a single cylinder that may be centered relative to the propulsion unit so as to avoid the hydrodynamic drag that may be created by the two laterally-straddling cylinders. It will be further desirable to reduce costs through the use of a single tilt/trim cylinder.

BRIEF SUMMARY OF THE INVENTION

Generally speaking, the present invention fulfills the foregoing needs by providing in one exemplary embodiment a stern drive system having an outdrive rotatable about a generally horizontal axis to impart a desired trim or tilt to the drive system. The system comprises a gimbal ring that defines an inner region. A tilt-trim assembly is affixed to the outdrive, and the tilt-trim assembly has one respective end thereof pivotally supported by the outdrive. The assembly includes a single cylinder through the inner region of the gimbal ring and has one end thereof pivotally connected to the gimbal ring so that when the cylinder is actuated the outdrive is rotated about the generally horizontal axis.

The present invention further fulfills the foregoing needs by providing in another aspect thereof a method of assembling a tilt-trim assembly for use in a stern drive system generally disposed aft of a boat transom and having an outdrive configured to be rotated about a generally horizontal axis to impart a desired trim or tilt to the drive system. The method allows for executing the following actions:

receiving a first anchor pin to be pivotally supported by a respective gimbal ring defining an inner region;

affixing the tilt-trim assembly to the outdrive section;

receiving a second anchor pin at one respective end of the tilt-trim assembly to be pivotally supported by the outdrive, the assembly including a single cylinder having one end thereof connected to the first anchor pin so that when the cylinder is activated the outdrive may be rotated about the generally horizontal axis; and positioning the cylinder so that its longitudinal axis intersects a respective axis that extends perpendicular relative to the generally horizontal axis and bisects the inner region of the gimbal ring.

BRIEF DESCRIPTION OF THE DRAWINGS

The features and advantages of the present invention will become apparent from the following detailed description of the invention when read with the accompanying drawings in which.

Figure 1:
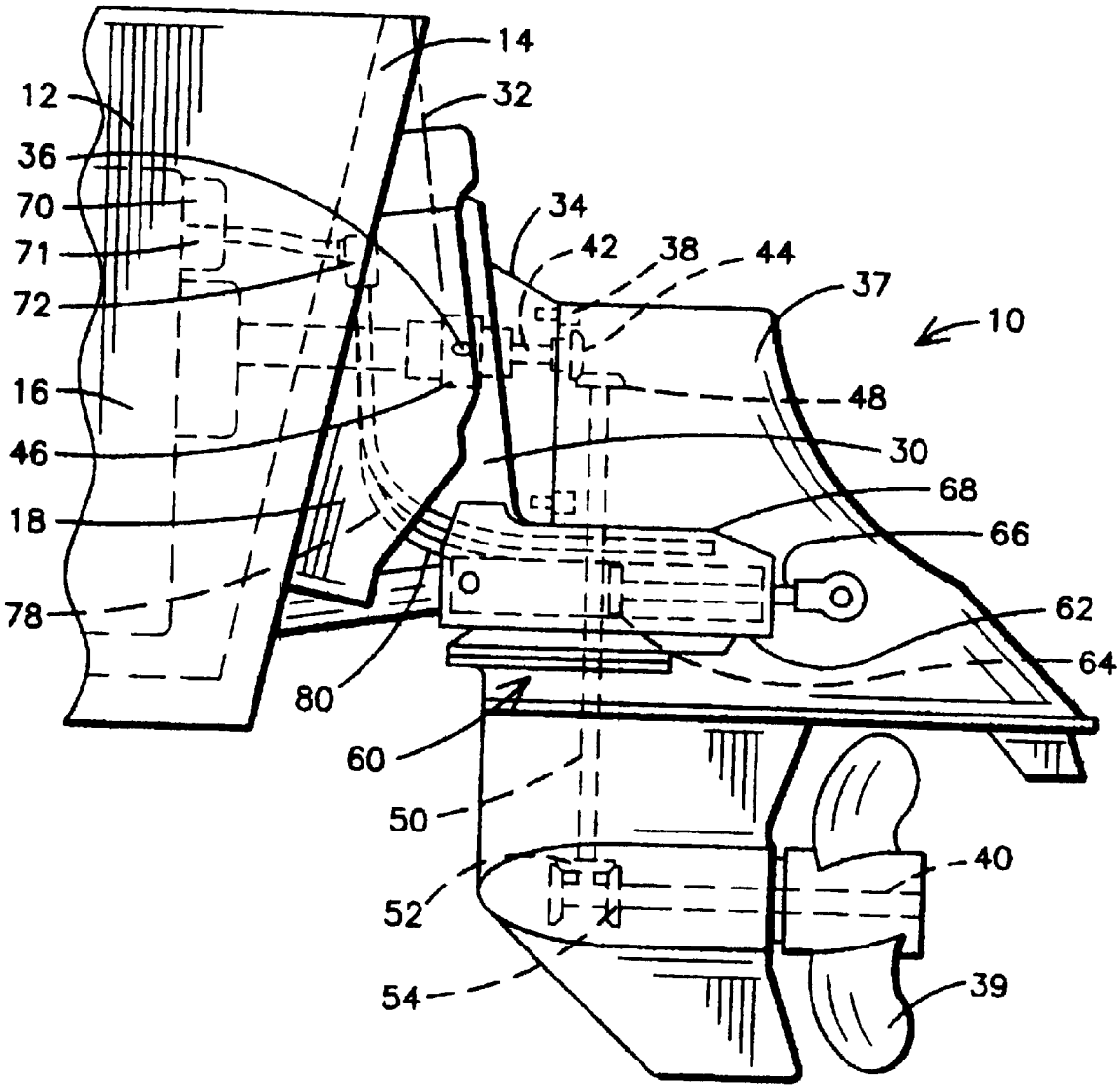
FIG. 1 PRIOR ART
FIG. 1 is a side elevational view of a prior art stern drive system for a boat.

Before any embodiment of the invention is explained in detail, it is to be understood that the invention is not limited in its application to the exemplary details of construction and arrangements of components set forth in the following description or illustrated in the drawings. For example, although the cylinder actuating means will be described in the context of hydraulic cylinders, it will be appreciated that in lieu of using hydraulic actuators, electromechanical actuators could be employed to impart the thrust required to tilt or trim the stern drive propulsion system. Thus, the invention is capable of other embodiments and of being practiced or being carried out in various ways. Also, it is to be understood that the phraseology and terminology used herein is for the purpose of illustrative description and should not be regarded as limiting.

DETAILED DESCRIPTION OF THE INVENTION

FIG. 1 illustrates an exemplary prior art marine propulsion device 10 mounted on a boat 12 having a transom 14. The marine propulsion device 10 is of the stern drive or inboard/outboard type. As best shown in FIG. 1, the marine propulsion device 10 comprises an engine 16 securely mounted on the boat frame by suitable means such as rubber mounts (not shown). The marine propulsion device 10 also comprises a mounting bracket or gimbal housing 18 mounted on the outer surface of the boat transom 14 and fixedly attached to the boat transom 14. The gimbal housing 10 can be attached to the boat transom 14 by any suitable means, such as by bolts extending through the transom 14.

The marine propulsion device 10 also comprises a gimbal ring connected to the gimbal housing 18 for pivotal movement relative to the gimbal housing 18 about a generally vertical steering axis 32, and a pivot housing 34 connected to the gimbal ring for pivotal movement relative to the gimbal ring about a generally horizontal tilt-trim axis 36. Such a construction is well known in the art and will not be described in detail other than as necessary for an understanding of the invention.

The marine propulsion device 10 also comprises an outdrive 37 that may be removably connected to the pivot housing 34 for common pivotal movement of the outdrive 37 with the pivot housing 34. In the illustrated construction, the outdrive 37 is removably connected to the pivot housing 34 by a plurality of bolts 38. The outdrive 37 includes a propeller 39 mounted on a propeller shaft 40, and a generally horizontal drive shaft 42 having one end removably connected to the engine 16 and an opposite end having thereon a bevel gear 44. A universal joint 46 attached to the horizontal drive shaft 42 allows pivotal movement of the drive shaft 42 with the propulsion unit 37. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

The marine propulsion device 10 also comprises a pair of hydraulic cylinder/piston assemblies 60 pivotally connected between the gimbal housing 18 and the outdrive 37 for effecting pivotal movement (tilt and trim movement) of the outdrive 37 relative to the gimbal housing 18 and relative to the gimbal ring about the tilt axis 36. The hydraulic cylinder/piston assemblies 60 are connected between the lower end of the gimbal ring and the outdrive 37. The cylinder/piston assemblies 60 extend on opposite sides of the propulsion unit 37. Each of the cylinder/piston assemblies 60 includes a cylinder 62 having an upper portion, a forward end pivotally connected to the gimbal ring, and a rearward end. The cylinder/piston assemblies 60 each also include a piston 64 slidably received in the cylinder 62 for reciprocal movement therein, the piston 64 dividing the cylinder 62 into forward and rearward pressure chambers. The cylinder/piston assemblies 60 also include a piston rod 66 having a forward or inner end fixedly attached to the piston 64 and extending outwardly of the rearward end of the cylinder 62, and a rearward or outer end pivotally attached to the propulsion unit 37. Increasing the pressure in the forward pressure chamber of the cylinder 62 causes the piston rod 66 to extend, thereby causing the propulsion unit 37 to tilt upwardly, and increasing the pressure in the rearward pressure chamber of the cylinder 62 causes the piston rod 66 to retract, thereby causing the propulsion unit 37 to tilt downwardly.

The marine propulsion device 10 further comprises a conduit having one end communicating with a tank 70 inside the boat 12. Tank 70 supplies and stores working hydraulic fluid that may be pressurized by a hydraulic circuit 71 having a motor pump also inside the boat. The conduit has an opposite end communicating with the hydraulic cylinder/piston assemblies 60. The conduit may extend through an opening in the gimbal housing and may be exposed to the environment external to the boat at least between the gimbal housing 18 and the cylinders 60. The conduit further includes a manifold 72, a first fluid line means that allows communication between the manifold 72 and the hydraulic cylinder/piston assemblies 60 for supplying hydraulic fluid to the cylinder/piston assemblies 60, and a second fluid line means extending through the opening in the gimbal housing 18 and having one end communicating with the source of fluid 70, and an opposite end communicating with the manifold 72. The first fluid line means includes a first pair of hydraulic lines communicating between the manifold 72 and the first or right cylinder 62. One of the hydraulic lines of the right pair may be connected to the forward end, e.g., the forward pressure chamber, of the right cylinder 62, and the other hydraulic line of the pair may be connected to the rearward end, e.g., the rearward pressure chamber of the right cylinder 62. The first fluid line means also includes a second pair of hydraulic lines 78 and 80 communicating between the manifold 72 and the second or left cylinder 62. One of the hydraulic lines of the left pair is connected to the forward end, e.g., the forward pressure chamber, of the left cylinder 62, and the other hydraulic line 80 of the left pair being connected to the rearward end, e.g., the rearward pressure chamber, of the left cylinder 62. As will be appreciated by those skilled in the art, although stern drive propulsions systems such as the above-described exemplary prior art system have proven to provide effective propulsion means to boat users, as suggested above and further described below, the present invention allows to even further enhance the reliability and ease of maintenance of such type of marine propulsion systems.

Figure 2:
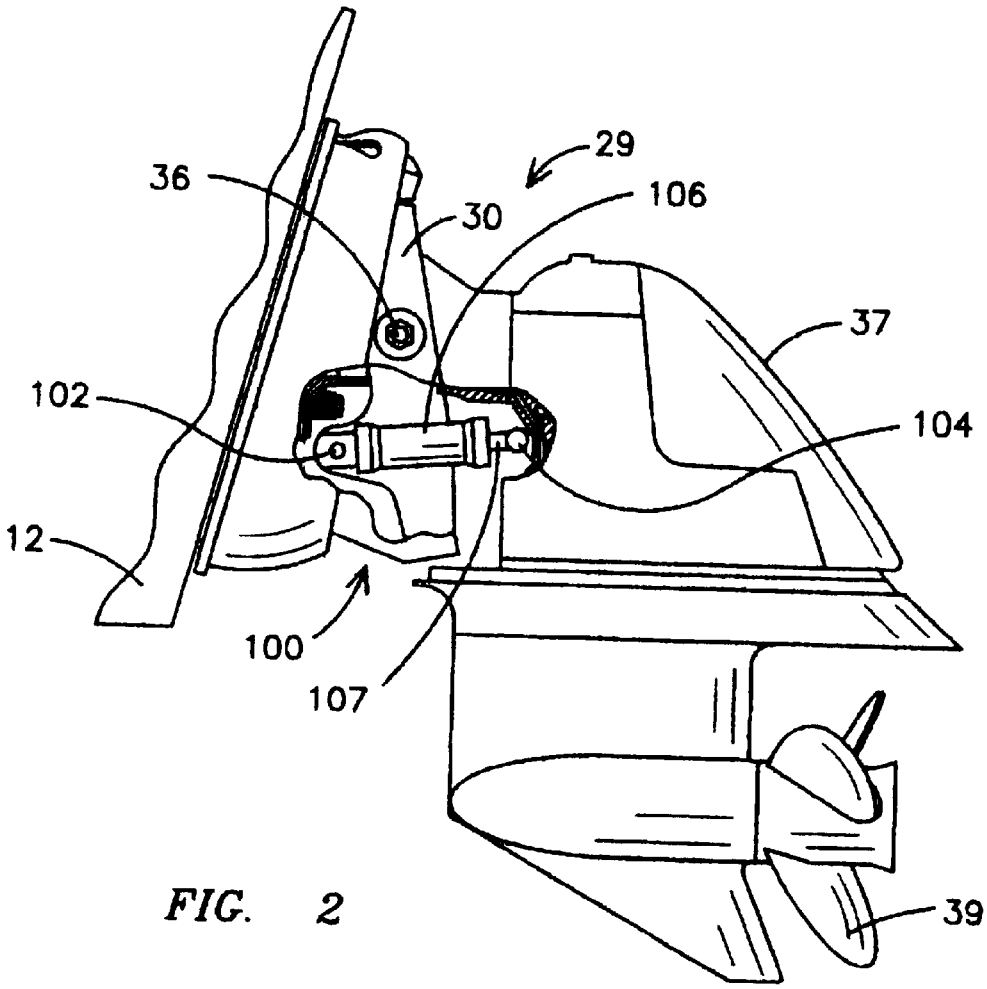
FIG. 2 is a side elevational view of an exemplary single-cylinder tilt-trim assembly embodying one aspect of the present invention.

FIG. 2 illustrates one exemplary embodiment of the present invention showing a tilt-trim assembly 100 in combination with a stern drive propulsion system. As shown in FIG. 2, the tilt/trim assembly 100 may be affixed to the outdrive 37 using any suitable affixing means, such as pivot pins disposed generally parallel relative to tilt-trim axis 36, etc. As further shown in FIG. 2, a gimbal ring 30, part of a gimbal unit 29, has means for receiving a first anchor pin 102. The tilt/trim assembly has one end configured to receive a second anchor pin 104 supported by the outdrive 37. The assembly 100 in particular includes only one cylinder 106. The cylinder includes a respective slidable piston 107 that may be pivotally connected at one end thereof to the second anchor pin. It will be appreciated that the piston end need not be connected to the second anchor pin since the cylinder/piston could be arranged opposite to the illustrated arrangement so that the piston would be connected to the first anchor pin in lieu of the second anchor pin.

Figure 3:
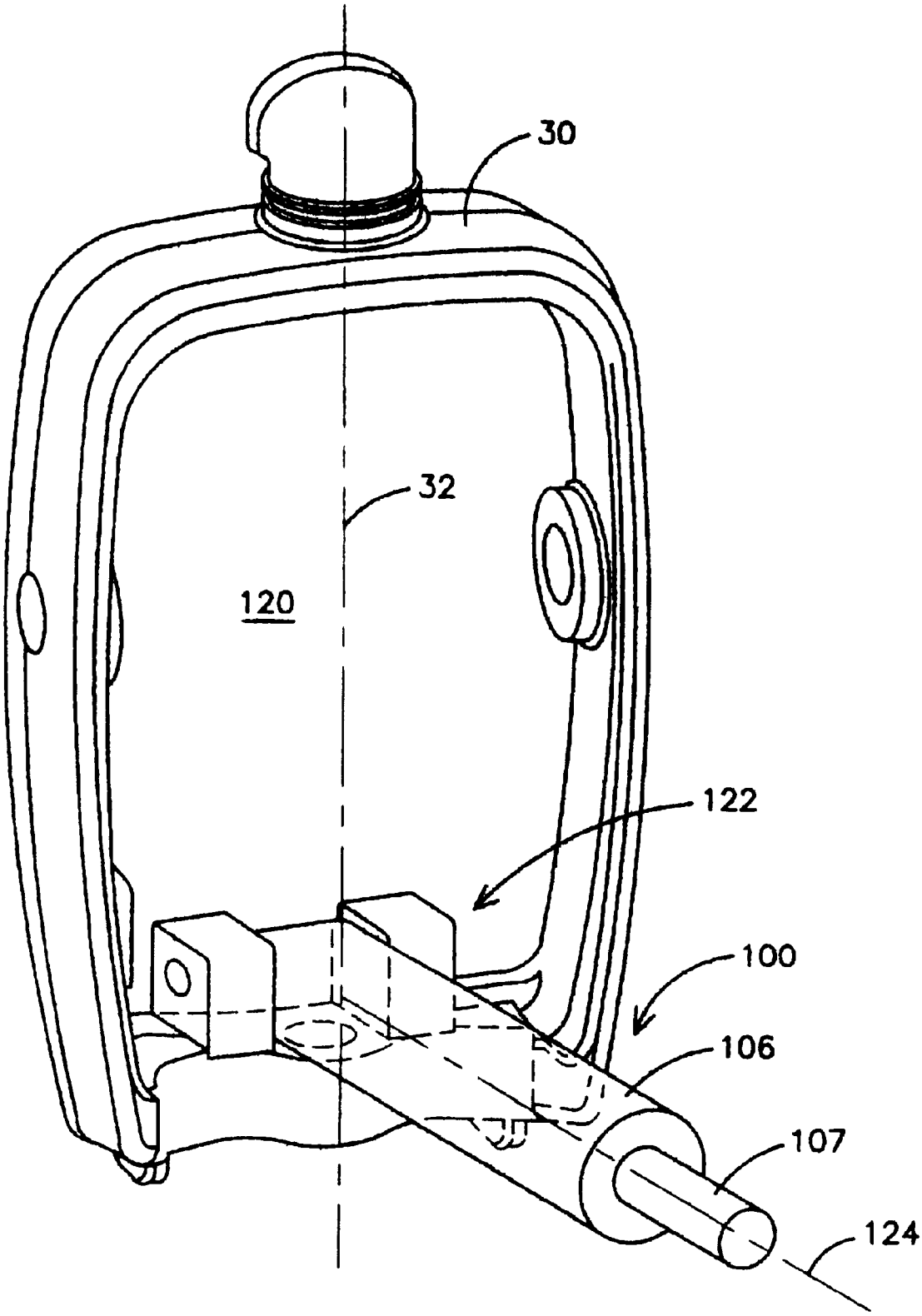
FIG. 3 is an isometric view illustrating an exemplary arrangement through an inner region defined by a gimbal ring for accommodating the single-cylinder tilt-trim assembly of FIG. 3.

As best appreciated in FIG. 3, in one key aspect of the present invention, gimbal ring 30 defines an inner region 120, and more particularly a lower inner region 122 through which cylinder 106 is centrally disposed. As shown in FIG. 3, the piston/cylinder assembly has a longitudinal axis 124 that intersects steering axis 32. As seen in FIG. 3, inner region 120 is bisected by steering axis 32. Centrally arranging the cylinder as illustrated in FIG. 3 allows for eliminating any laterally straddling cylinders that could result in undesirable hydrodynamic drag. Further, such central arrangement of cylinder 106 allows for vertically pivoting outdrive 37 without creating any undesirable tortional moment that could result if the single cylinder was not centrally positioned in the middle of the inner region defined by gimbal ring 30.

Figure 4:
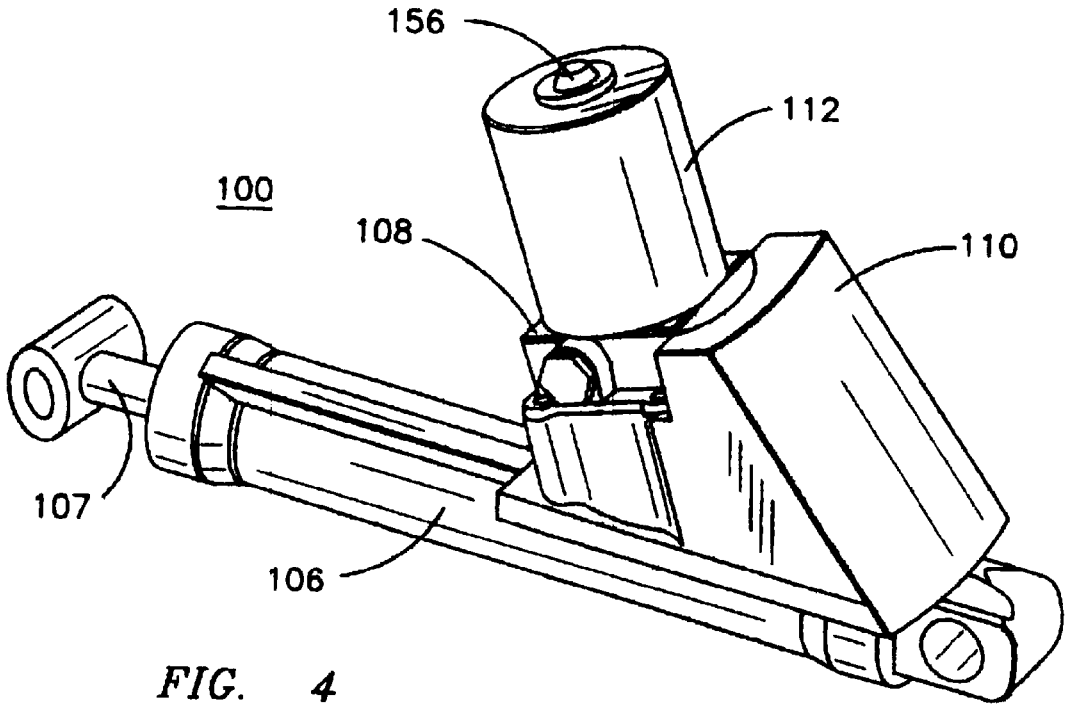
FIG. 4 is an isometric view of another exemplary embodiment of the tilt-trim assembly illustrating another aspect of the present invention.

It will be appreciated that, as suggested above, tilt-trim assembly 100 may include a fluid circuit located in the interior of the boat, or if desired tilt-trim assembly 100 may include a fluid circuit exteriorly located relative to the interior of the boat. In the event the fluid circuit is located outside the boat, one exemplary construction is shown in FIG. 4. By way of example, cylinder 106 and the tilt-trim assembly may comprise a unitized body, i.e., they may comprise one integral unit that may be constructed using well-known and readily understood casting techniques to those of ordinary skill in the art, e.g., die casting, etc. An exemplary material for the assembly may be aluminum or any other relatively light weight and high strength, and substantially corrosion-resistant material.

As further shown in FIG. 4, in this exemplary embodiment assembly 100 may include the fluid circuit, e.g., a hydraulic or pneumatic circuit, to be completely self-contained within the assembly for actuating the cylinder 106 and thus avoiding the various issues generally associated with tilt/trim systems that require externally exposed conduits or hoses for passing hydraulic fluid between the interior and exterior of the boat. In a preferred embodiment, the hydraulic circuit may be chosen due to its good shock absorbing characteristics. As will be appreciated by those skilled in the art, the hydraulic circuit may be configured using design techniques readily understood by those of ordinary skill in the art. By way of example, the hydraulic circuit may include a pump 108 and a fluid storage tank 110 connected to pass hydraulic fluid to the pump. The pump 108 may be driven by a motor 112, e.g., a reversible DC motor, in response to externally-derived signals supplied to the motor by way of suitable electrical leads. Both the motor and the pump and any associated hydraulic valves, e.g., relief valves, thermal relief valves, manual release valves, etc., may be disposed in respective compartments within the assembly sufficiently sealed to prevent entry of moisture therewithin.

By way of example and not of limitation, the tilt/trim assembly may include internal passages to provide fluid communication between the pump, the cylinders and the tank. For example, one of the passages may provide a path for supplying pressurized fluid to a pressure chamber of a respective cylinder, and the other passage may provide a return path for fluid returning to the pump and/or storage tank. The passages may be bored using standard drilling techniques or may be configured while the assembly is cast using a mold configured to define such internal passages. Alternatively, in lieu of providing internal passages, external tubing could be used to provide the supply and return paths to the fluid flowing into or out of the respective cylinders. It will be appreciated that since the assembly 100 rotates together with the outdrive, then in this embodiment the tubing would not be subject to any bending while the outdrive is being tilted. Similarly, since the length of the tubing is substantially short since the hydraulic circuit and the cylinders are contained substantially proximate to one another, then one could use an inexpensive shield to protect the tubing from the external environment. It will be further appreciated by those skilled in the art, that having shorter hydraulic conduits, either externally or internally located, will result in improved shock transient response from the hydraulic circuit in the event the propulsion unit were to strike an underwater obstruction or object.

Thus, in the above-described embodiment, since the single cylinder in the tilt/trim assembly comprises a unitized structure and is angularly movable in unison relatively to the gimbal housing, and further since the working hydraulic fluid conduits interconnecting the motor pump, and the tilt/trim cylinder therein may now be defined, if so desired, without employing exteriorly installed tubing, then such embodiment would allow for either avoiding altogether, in the case of internal passageways, or substantially avoiding, in the case of short external tubing, the problem of fluid conduit corrosion, etc. Further, the tilt-trim system may be constructed as a single assembly with the hydraulic pressure circuit incorporated in the assembly. Thus, the tilt-trim system can easily be attached to and detached as a kit from the outdrive and the gimbal housing. As suggested above, the assembly of this embodiment because of its integrated construction and improved transient response characteristics may provide increased protection against shocks that may be produced when the propulsion unit is hit by objects, such as driftwood, etc. In arrangements where volumetric spacing is at a premium, one may locate the fluid circuit and associated components in the interior of the boat.

While the preferred embodiments of the present invention have been shown and described herein, it will be obvious that such embodiments are provided by way of example only. For example, although some aspects of the present invention have been described in the context of an hydraulic circuit, it will be appreciated that in lieu of using hydraulic cylinders, torque-applying screws rotated by a respective electromechanical actuator could be employed to impart the torque required to tilt or trim the stern drive propulsion system. Thus, numerous variations, changes and substitutions will occur to those of skill in the art without departing from the invention herein. Accordingly, it is intended that the invention be limited only by the spirit and scope of the appended claims.

What is claimed is:

1. A stern drive system having an outdrive rotatable about a generally horizontal axis to impart a desired trim or tilt to the drive system, the system comprising:

a gimbal ring defining an inner region, the gimbal ring pivotally mounted in a gimbal housing to allow pivotal movement relative to the gimbal housing; and a tilt-trim assembly having a single cylinder to rotate the outdrive, the tilt-trim assembly having one respective end thereof pivotally supported by the outdrive, the single cylinder extending through the inner region of the gimbal ring and having one end thereof pivotally connected to the gimbal ring so that when the cylinder is actuated the outdrive is rotated about the generally horizontal axis.

2. The drive system of claim 1 wherein the one end of the single cylinder is connected to a first anchor pin supported by the gimbal ring and the opposite end of the single cylinder comprises a piston connected to a second anchor pin supported by the outdrive to impart rotation in a first direction upon the piston being extended and in a second direction opposite the first direction upon the piston being retracted.

3. The drive system of claim 2 wherein the piston has a longitudinal axis positioned to intersect a respective axis that extends perpendicular relative to the generally horizontal axis and bisects the inner region of the gimbal ring.

4. The drive system of claim 1 further comprising a circuit for actuating the single cylinder therein.

5. The drive system of claim 4 wherein the circuit is selected from the group consistent of hydraulic, pneumatic or electromechanical circuits.

6. The drive system of claim 1 wherein the single cylinder and the tilt-trim assembly comprise a unitized body.

7. The drive system of claim 6 wherein the unitized body is an integral body.

8. The drive system of claim 1 wherein the single cylinder and the tilt trim assembly are affixed to one another as a single assembly.

9. A boat having a stern drive propulsion system including ail outdrive rotatable about a predetermined axis to impart a desired trim or tilt to the drive system, the boat comprising:

a gimbal ring configured to pivotally receive a first anchor pin; and a tilt-trim assembly affixed to the outdrive, the tilt-trim assembly having one respective end thereof configured to pivotally receive a second anchor pin supported by the outdrive, the assembly including a single cylinder centered through a lower inner region defined by the gimbal ring and having one end thereof connected to the first anchor pin so that when the cylinder is actuated the outdrive is rotated about the predetermined axis, the assembly further including a piston connected to the second anchor pin to impart rotation in a first direction upon the piston being extended and in a second direction opposite the first direction upon the piston being retracted.

10. The boat of claim 9 further comprising a circuit for actuating the single cylinder therein.

11. The boat of claim 10 wherein the circuit is selected from the group consisting of hydraulic, pneumatic or electromechanical circuits.

12. The boat of claim 10 wherein the circuit is located in the interior of the boat.

13. The boat of claim 10 wherein the circuit is exteriorly located relative to the interior of the boat.

14. A tilt-trim assembly for use with an outdrive of a stern drive supported by a gimbal ring defining an inner region, the ring pivotally mounted in a gimbal housing to allow pivotal motion relative to the gimbal housing and, the outdrive configured to rotate about a predetermined axis to impart a desired trim or tilt to the drive system, the tilt-trim assembly having one respective end in the inner region configured to pivotally receive one anchor pin supported by the gimbal ring, the assembly including a single cylinder having one end thereof configured to pivotally connect to another anchor pin supported by the outdrive so that when the cylinder is actuated the outdrive is rotatable about the predetermined axis.

15. The tilt-trim assembly of claim 14 wherein the one end of the single cylinder comprises a piston connected to said another anchor pin to impart rotation in a first direction upon the piston being extended and in a second direction opposite the first direction upon the piston being retracted, the piston hating a longitudinal axis positioned to intersect a respective axis that extends perpendicular relative to the predetermined axis and bisects the inner region defined by the gimbal ring.

16. A method of assembling a tilt-trim assembly for use in a stern drive system generally disposed aft of a boat transom and having an outdrive configured to be rotated about a generally horizontal axis to impart a desired trim or tilt to the drive system, the method comprising:

receiving a first anchor pin to be pivotally supported by a respective gimbal ring defining an inner region, the gimbal ring pivotally mounted in a gimbal housing to allow pivotal movement relative to the gimbal housing;

affixing the tilt-trim assembly to the outdrive section;

receiving a second anchor pin at one respective end of the tilt-trim assembly to be pivotally supported by the outdrive, the assembly including a single cylinder having one end thereof connected to the first anchor pin so that when the cylinder is activated the outdrive may be rotated about the generally horizontal axis; and positioning the cylinder to extend perpendicular relative to the generally horizontal axis and bisect the inner region of the gimbal ring.

17. A stern drive system having an outdrive configured to be rotated about a generally horizontal axis to impart a desired trim or tilt to the drive system, the system comprising:

means for receiving a first anchor pin to be pivotally supported by a respective gimbal ring defining an inner region;

means for affixing the tilt-trim assembly to the outdrive section;

means for receiving a second anchor pin at one respective end of the tilt-trim assembly to be pivotally supported by the outdrive, the assembly including a single cylinder having one end thereof connected to the first anchor pin so that when the cylinder is activated the outdrive may be rotated about the generally horizontal axis; and means for centrally positioning the cylinder through the inner region defined by the gimbal ring so that its longitudinal axis intersects a respective axis that extends perpendicular relative to the generally horizontal axis.

18. A gimbal ring and tilt-trim assembly for a stern drive, the gimbal ring having an inner region being configured to receive the tilt-trim assembly centered through the inner region and comprising a single cylinder pivotally connected to the gimbal ring, the tilt-trim assembly further comprising a piston pivotally connected to an outdrive unit, the piston being responsive to a respective actuating circuit for causing rotation of the outdrive in a first direction upon the piston being extended and in a second direction opposite the first direction upon the piston being retracted.

19. A tilt-trim assembly for use with an outdrive of a stern drive supported by a gimbal ring defining an inner region, the outdrive configured to rotate about a predetermined axis to impart a desired trim or tilt to the drive system, the tilt-trim assembly having one respective end in the inner region configured to pivotally receive one anchor pin supported by the gimbal ring, the assembly including:

an actuator configured to pivotally connect to another anchor pin supported by the outdrive; and an actuating device configured to actuate the actuator to rotate the outdrive about the predetermined axis.

20. A stern drive system having an outdrive rotatable about a generally horizontal axis to impart a desired trim or tilt to the drive system, the system comprising:

a gimbal housing affixable to a transom of a watercraft;

a gimbal ring defining an inner region and pivotally mounted to the gimbal housing;

a single cylinder-piston assembly, the assembly having one respective end thereof pivotally supported by the outdrive and having an opposite end pivotally connected to the inner region of the gimbal ring and exteriorly of the transom so that when the cylinder-piston assembly is actuated, the outdrive is rotated about the generally horizontal axis.

21. The tilt-trim assembly of claim 19 wherein the actuator includes a cylinder and the actuating device includes a piston.

22. The stern drive system of claim 1 wherein the gimbal housing is mounted to the exterior surface of a boat transom and the one end of the single cylinder is pivotally connected to the gimbal ring such that the one end is outboard of the boat.

* * * * *

UNITED STATES PATENT AND TRADEMARK OFFICE

CERTIFICATE OF CORRECTION

PATENT NO. : 6,607,410 B1
DATED : August 19, 2003
INVENTOR(S) : Neisen et al.

It is certified that error appears in the above-identified patent and that said Letters Patent is hereby corrected as shown below:

Title page,
Item [75], Inventors, delete "Gerlad" and substitute therefor -- Gerald --;

Column 7,
Line 28, delete the word "hating" and substitute therefore -- having --;

Signed and Sealed this

Thirteenth Day of January, 2004

JON W. DUDAS
*Acting Director of the United States Patent and Trademark Office*